US008312607B2

(12) United States Patent
Pecherzewski

(10) Patent No.: US 8,312,607 B2
(45) Date of Patent: Nov. 20, 2012

(54) IMPELLER INSTALLATION TOOL

(76) Inventor: Andrzej Pecherzewski, Culver City, CA (US)

( * ) Notice: Subject to any disclaimer, the term of this patent is extended or adjusted under 35 U.S.C. 154(b) by 295 days.

(21) Appl. No.: 12/642,752

(22) Filed: Dec. 18, 2009

(65) Prior Publication Data

US 2011/0146044 A1 Jun. 23, 2011

(51) Int. Cl.
*B25B 27/14* (2006.01)

(52) U.S. Cl. ..... 29/278; 29/270; 29/428

(58) Field of Classification Search ..... 29/235, 29/242, 243, 255, 267, 269–271, 283.5, 889.1, 29/278

See application file for complete search history.

(56) References Cited

U.S. PATENT DOCUMENTS 1,363,522 A * 12/1920 Leitch ..... 29/235
1,537,549 A * 5/1925 Raffay ..... 29/271
1,739,270 A * 12/1929 Thiry ..... 29/898.04
3,158,923 A * 12/1964 Reinsma ..... 29/898.11
3,952,393 A * 4/1976 van Ravenzwaay et al. ... 29/795
4,570,323 A * 2/1986 Legerius et al. ..... 29/451
5,864,951 A * 2/1999 Campagnolo ..... 29/894
6,394,753 B1 * 5/2002 Maki et al. ..... 416/146 R
6,427,301 B1 * 8/2002 Foster ..... 29/222
2009/0199382 A1 * 8/2009 Heaton ..... 29/270

* cited by examiner

*Primary Examiner* — David B Thomas
(74) *Attorney, Agent, or Firm* — Holland & Knight LLP; Richard E. Lyon, Jr.

(57) ABSTRACT

A tool for installing a flexible impeller on a drive shaft in the impeller cavity in a water pump including a gripping surface extending about an upper portion of the tool and an open ended channel extending axially through the tool for receiving and releasably retaining a flexible impeller therein in a compressed state. The channel has an upper portion circumscribed by an annular outwardly inclined impeller abutment surface and a lower constant radius portion circumscribed by a depending cylindrical wall. The inclined impeller abutment surface terminates in the constant radius portion.

22 Claims, 3 Drawing Sheets

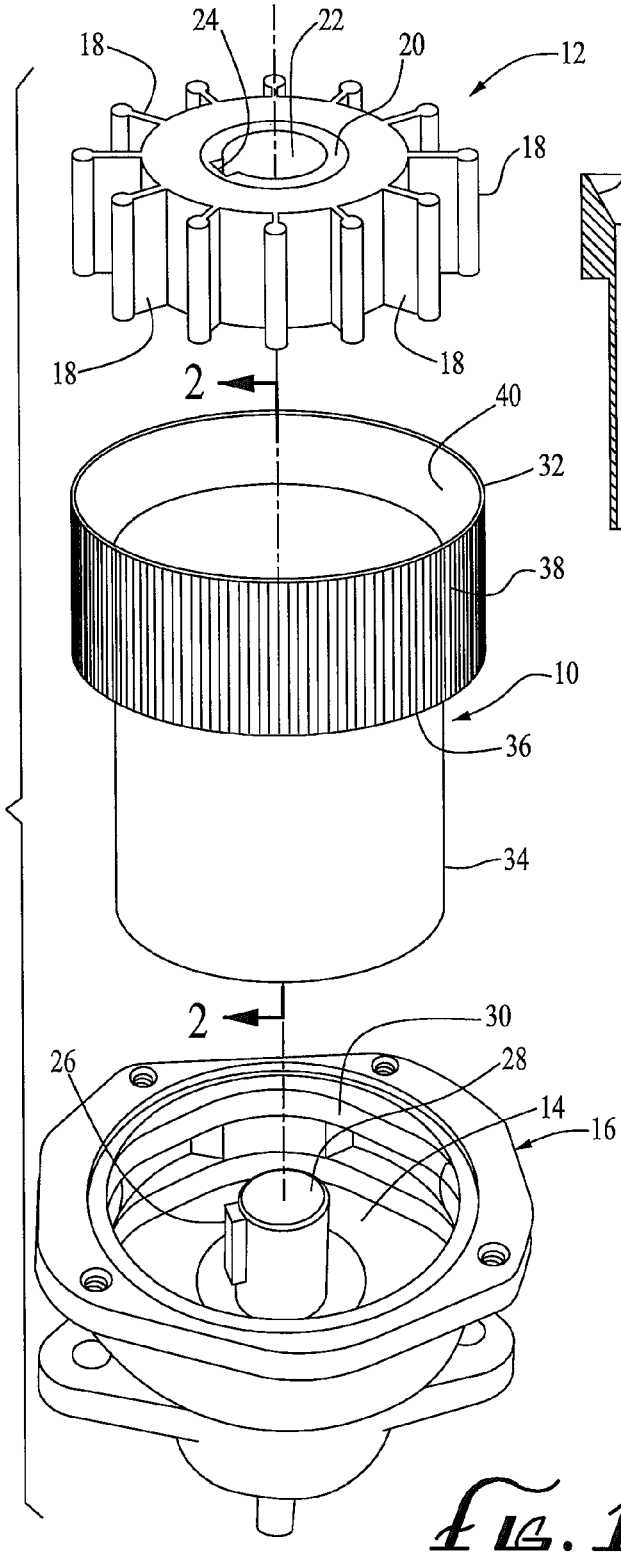
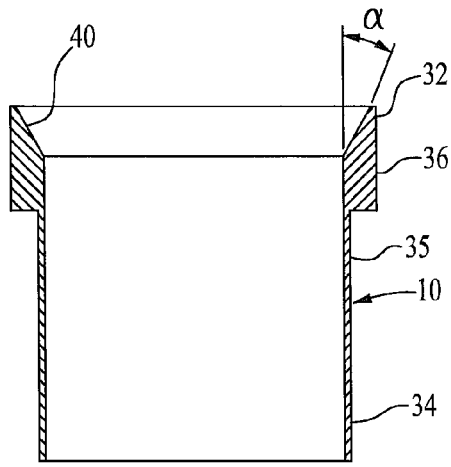
FIG. 2
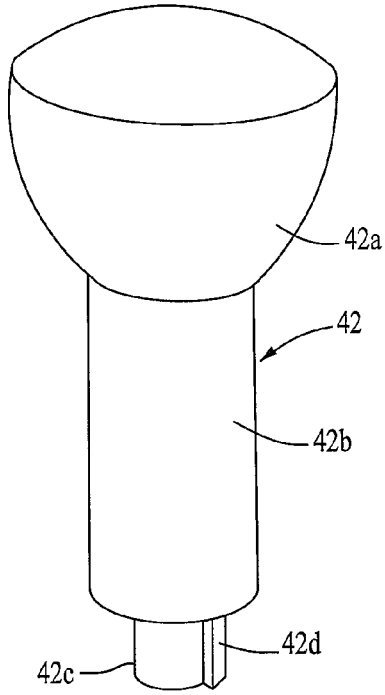
FIG. 1 FIG. 3

FIG. 6
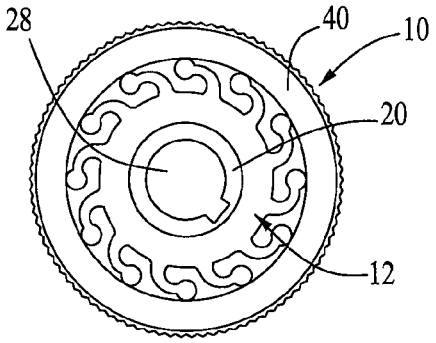
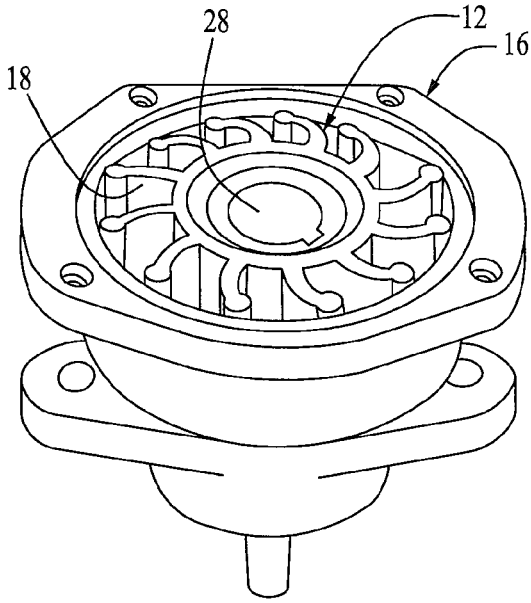
FIG. 8
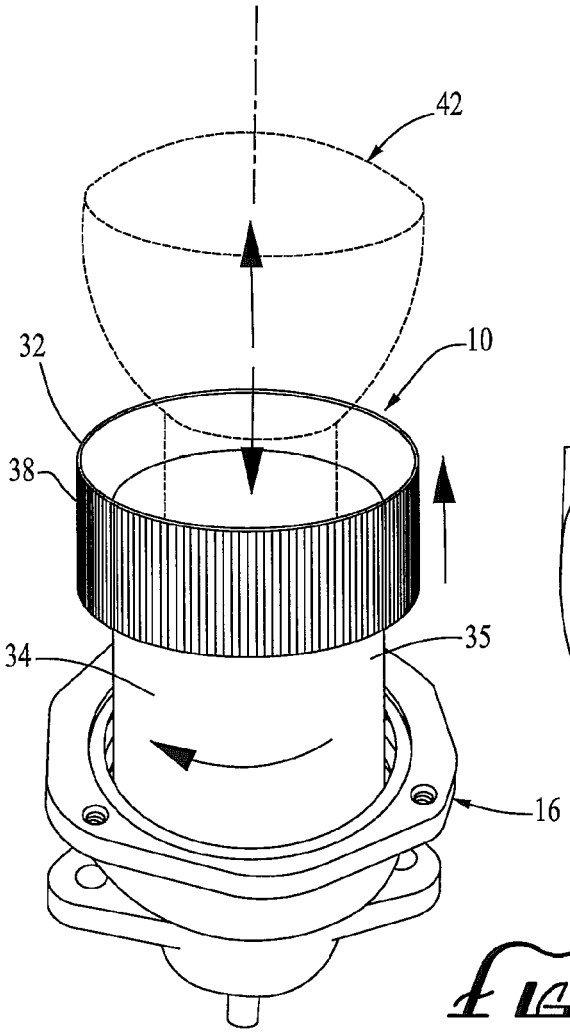
FIG. 7
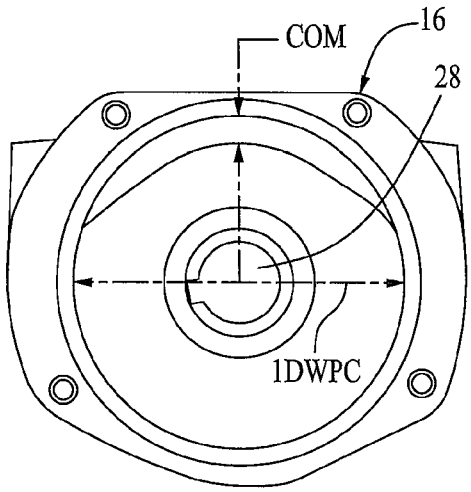
FIG. 9

IMPELLER INSTALLATION TOOL

BACKGROUND OF THE INVENTION

The present invention relates to a tool for installing flexible impellers in water pumps, particularly raw water pumps in marine applications. Typically, these impellers are installed by hand which requires pressing the impeller against the cam surface that is formed on an upper side of the impeller cavity wall in the water pump while concurrently rotating the impeller into alignment with the water pump drive shaft such that the key, serrations, flat surface(s) or other keying means on the impeller hub is aligned with the corresponding groove or other keying means on the water pump drive shaft. The impeller is then urged downwardly onto the shaft while being rotated with the shaft and against the stationary cam and cavity wall so as to uniformly deform and align the impeller blades within the impeller cavity. The impeller is then pressed to the bottom of the cavity for rotation therein with the impeller blades uniformly pressing against the impeller cavity wall. This task can be somewhat difficult when conducted on a work bench, but is extremely difficult when the pump is mounted on an engine where both view of the water pump and access thereto can be extremely limited. Installation is made even more difficult in larger pump applications where the impeller blades are thicker and more rigid and thus more difficult to bend into place.

As a result of the difficulty in installing these impellers, tools such as screw drivers have also been used to help force the impeller into place. However, the use of such devices can easily damage the impeller. It would be highly desirable to provide a tool that facilitated the installation of flexible impellers on water pumps and did so in a manner that would not risk the integrity of the impeller. The present invention provides such a tool.

SUMMARY OF THE PRESENT INVENTION

Briefly, the impeller installation tool of the present invention defines an upper portion and a lower portion. The extension of the upper portion of the tool defines an enlarged diameter outer tool gripping surface and the interior thereof defines an inclined interior impeller engaging surface. The lower portion of the tool is of a cylindrical configuration and is defined by a relatively thin wall to minimize the necessary compression of the impeller during installation. The lower portion of the tool depends from the upper portion thereof such that the inclined interior surface in the upper tool portion terminates at its lower end in the cylindrical interior surface of the lower portion of the tool.

The impeller is loaded onto the tool by pressing a plurality of the impeller blades against the inclined impeller engaging surface in the upper end of the tool while concurrently rotating the impeller in the direction of the rotation of the water pump shaft onto which it is to be mounted and urging the impeller downwardly into the tool, causing uniform rearward deformation of the impeller blades about the central impeller axis. The impeller is then pressed to the lower portion of the tool in its compressed state. With the impeller so loaded in the tool in a substantially uniformly deformed state, the tool is inserted into the impeller cavity in the water pump in axial alignment with the water pump shaft and rotated with respect thereto until the keying feature on the impeller hub is brought into axial alignment with the corresponding keying feature on the pump shaft. The impeller is then pushed downwardly within the tool about and along the shaft to the bottom of the impeller cavity. The tool is then pulled upwardly from the cavity as it is again rotated in the direction of rotation of the shaft on which it is mounted. The friction between the engaged impeller hub and pump shaft will maintain the impeller in place on the shaft as the tool is removed from the impeller cavity, leaving the impeller properly positioned on the pump shaft within the impeller cavity such that the uniformly deformed blades bear outwardly against the impeller cavity wall.

It is the principle object of the present invention to provide a tool for facilitating the installation of a flexible impeller in a water pump.

This and other objects and advantages of the present invention will become readily apparent from the following detailed description taken in conjunction with the accompanying drawings.

BRIEF DESCRIPTION OF THE DRAWINGS

FIG. 1 is an exploded perspective view showing the tool of the present invention aligned with a flexible impeller and a water pump impeller cavity.

FIG. 2 is a cross sectional view of the tool of the present invention taken along line 2-2 of FIG. 1.

FIG. 3 is a perspective view of an example of a pressing device that can be employed with the impeller installation tool of the present invention to facilitate the loading of the impeller into the installation tool.

FIG. 6 is a top plan view of the impeller fully loaded into the tool of the present invention for installation into a water pump.

FIG. 7 is a perspective view illustrating the movement of the pressing device of FIG. 3 and the impeller installation tool of the present invention during the use thereof to urge the impeller downwardly within the tool into place on the water pump shaft within the impeller cavity, the removal of the pressing device from the installation tool and the subsequent removal of the tool from the impeller cavity so as to leave the impeller in place on the shaft in the cavity and wherein the pressing device of FIG. 3 is illustrated in broken lines.

FIG. 8 is a perspective view showing the impeller fully installed in the impeller cavity of the water pump.

FIG. 9 is a top plan view of a portion of the water pump showing the impeller cavity and the pertinent dimensions thereof for the sizing of the tool of the present invention.

DETAILED DESCRIPTION OF THE PREFERRED EMBODIMENT

Figure 4:
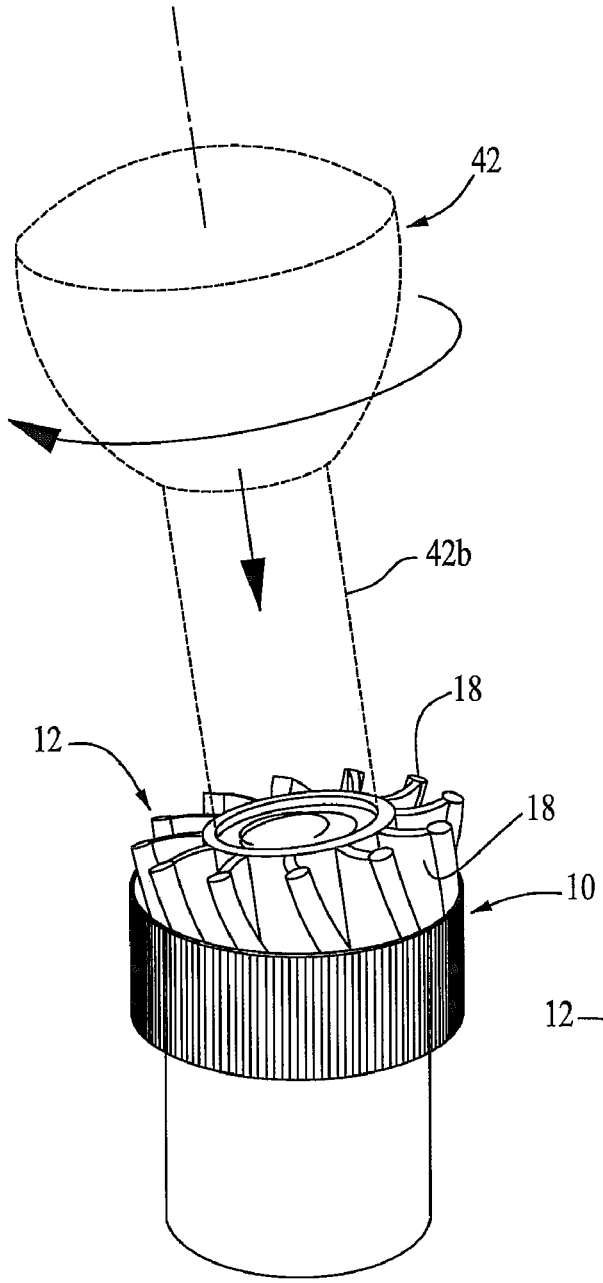
FIG. 4 is a perspective view showing the initial stage of the loading of the impeller into the tool of the present invention with the pressing device of FIG. 3 being utilized and wherein the pressing device is illustrated in broken lines.

Referring now in detail to the drawings, the impeller installation tool 10 of the present invention is configured to facilitate the installation of an impeller 12 into the impeller cavity 14 of a water pump 16, all of which are illustrated in FIG. 1. The water pump 16 for which tool 10 is particularly designed is a raw water pump used in marine engines, although the tool could be used in other applications. The impeller 12 is a representative configuration of impellers employed in such applications and comprises a plurality of flexible blades 18, a hub 20 circumscribing a water pump shaft receiving channel 22 and defining a keying feature 24 adapted to mate with a corresponding keying feature 26 on the pump shaft 28. As illustrated in FIG. 1, the water pump shaft 28 is provided with a rectangular key 26 that is adapted to be received within a correspondingly configured key slot 24 in the impeller hub. It is to be understood that a wide variety of keying configurations, including serrations and the use of one or more mating flat surfaces could be employed on the shaft 28 and in hub 20 to effect an interference fit between the impeller and the drive shaft such that rotation of the shaft is imparted to the impeller upon the impeller being mounted on the shaft within the impeller housing 14.

To install a flexible impeller such as impeller 12 onto the shaft of a raw water pump, it heretofore has been necessary to manually deform the impeller blades 18 in a uniform direction while inserting the impeller into the cavity. A cam 30 is provided adjacent to the outer end of the impeller cavity wall of such pumps to facilitate impeller installation. As seen in FIG. 9, cam 30 projects radially inwardly along a curvilinear path adjacent to the upper end of a portion of the cavity side wall, enabling the installer to press the outermost surfaces of a plurality of the impeller blades 18 against the camming surface as the impeller is rotated therealong in the normal direction of rotation of water pump shaft 28 during use. As the impeller is pressed against the cam and rotated, it is urged downwardly into the cavity with the hub 20 of the impeller aligned with the shaft to effect the keying therebetween. As the impeller blades 18 are urged against the cam 30 they are deformed rearwardly. After the impeller hub is keyed to the pump shaft, the installer continues to rotate the impeller with respect to the water pump while urging the impeller downwardly within the cavity to effect uniform rearward deflection of all of the impeller blades such that the blades bear against the impeller cavity wall in a turbine-like configuration at the base of the cavity. Because of the thickness of blades 18, this is a difficult task that is rendered far more difficult when the impeller must be installed while mounted on an engine where both visibility and access can be and generally are extremely limited.

The impeller installation tool 10 of the present invention facilitates this installation process and defines an upper portion 32 and a lower portion 34. The upper portion 32 defines a radially projecting portion 36, preferably having serrations 38 formed in the outer surface thereof so as to define a gripping handle for holding and rotating the tool 10. The upper tool portion also defines an interior surface 40 that is inclined downwardly and inwardly, preferably at an angle of inclination a of about 30° with respect to the vertical (see FIG. 2) to effect the desired deflection of the impeller blades as will be described.

The lower portion 34 of the tool is cylindrical, and is defined by a relatively thin wall 35. To minimize the amount of deflection of the impeller blades 18 necessary to provide sufficient deformation or compression of the impeller 12 to effect the insertion thereof within the tool 10, tool wall 35 should be as thin as possible. However, the wall must also be relatively rigid and durable so that it will not undergo any permanent deformation under the stress of impeller installation. Preferably, the tool 10 is of single piece configuration and machinable. It has been found that by forming the tool 10 of aluminum, a wall thickness can be of about 0.030-0.055 inches is suitable for lower tool portion 34. A thicker wall would provide additional strength, but also would reduce the area within the tool within which the impeller must be positioned, requiring greater deformation of the impeller and thus increasing the difficulty of the task.

While approximately 30° has been found to be the most preferred angle $\alpha$ for the inclined surface 40 in the upper portion of tool 10, an acceptable range for such an angle would be about 15-45° . While the tool could be workable within the range of about 10-60° , the steeper the angle of inclination of (i.e., the smaller the angle $\alpha$ in FIG. 2), the more gradual the compression of the impeller blades, and thus the longer the axial upper portion of the tool would have to be to obtain the necessary compression of the blades to insert the impeller within the tool. The shallower the angle, the more difficult it would be to deflect the blades. Accordingly, the usable angles for surface 40 will depend upon the stiffness of the blades. Approximately 30° , however, has been found to be well suited for a wide variety of impeller configurations while concurrently providing a relatively short handle portion for the tool and thus a relatively compact tool 10.

The outer diameter of the lower portion 34 of tool 10 is important and depends upon the size of the cavity in the pump within which the impeller is designed to operate. When the tool 10 is inserted into the impeller cavity 14, the outer surface of the lower portion of the tool must be adjacent to the impeller cavity wall to properly locate the tool within the cavity and axially align the impeller carried therein with the water pump shaft. The tool provides this self-aligning feature by sizing, the preferred outer diameter of the lower portion 34 of tool 10 according to the following:

$$OD = IDWPC - (2 \times COM) - 0.003 \text{ in. (or metric equivalent)}$$

wherein:

IDWPC=inner diameter of water pump cavity

COM=the thickness of the cam at its widest point 0.003 in.=a clearance factor

These dimensions are represented in FIG. 9.

By way of example only, an installation tool 10 of the present invention can be formed of machined aluminum and have an inner diameter of the lower tool portion 34 of about 1.936 in., a wall thickness of the lower portion of the tool within the range of about 0.035-0.40 in., an angle of inclination $\alpha$ for the inclined interior surface 40 in the upper portion of the tool of about 30° and an inclined interior surface length of about 0.50 in. The size of the tool will, of course, vary depending on the size of the impeller.

In use, the tool 10 can be used to install an impeller 12 in an impeller cavity 14 of a water pump 16 either by hand or with the aid of a pressing device 42. A representative example of such a device is illustrated in FIG. 3. FIGS. 4-8 illustrate the insertion of impeller 12 in cavity 14 using the pressing device 42. The installation process, however, is essentially the same with or without the assistance of a pressing device. The following description includes the use of such a device.

As seen in FIG. 4, the impeller 12 is first loaded into the tool 10 by pressing the impeller blades 18 against a portion of the inclined inner surface 40 in the upper tool portion 36 while rotating the impeller at a slightly downward inclination in the direction of the rotation of the water pump shaft 28 during actual use of the pump, as illustrated in FIG. 4. This initial loading step is similar to the insertion of the impeller directly into the impeller cavity 14 in the water pump using the cam 30 as described in paragraph above, except that the loading of the impeller 12 onto tool 10 is considerably easier because of the inclined wall 40 in the upper end of the tool and the user's ability to position and hold the tool 10 in a convenient and clearly visible orientation while inserting the impeller therein. By manually, or with the assistance of a pressing device, urging the impeller downwardly while rotating the impeller in the direction of rotation of the water pump drive shaft as above described, the impeller 12 is inserted into the upper cylindrical portion of the tool with the impeller blades 18 uniformly deformed away from the direction of rotation as illustrated in FIG. 5.

An example of a pressing device 42 that could be used with the impeller installation tool 10 of the present invention is shown in FIG. 3. The device comprises an upper handle portion 42*a* and a body portion 42*b* that depends from the handle portion and is sized so as to bear against the hub 20 of impeller 12 for assisting in forcefully urging the impeller 12 into and through the upper portion 32 of tool 10. A cylindrical projection 42*c* depends from the center of the underside of body portion 42*b* and is sized similarly to the drive shaft 28 of the water pump 16 and is provided with a key 42*d* similar in size and configuration to the key 46 on the water pump drive shaft. By inserting the extending the lower projection 42*c* on the pressing device 42 into the central opening 22 defined by the impeller hub 20 such that the key 42*d* on the pressing device extends into the correspondingly sized keying feature 24 in the impeller hub, the pressing device can be used both to press the impeller downwardly within the tool 10 and to rotate the impeller with respect to the tool during insertion as described above and illustrated in FIGS. 4 and 5. This insertion operation can be facilitated by applying soapy water or another suitable lubricant to the impeller prior to insertion.

Figure 5:
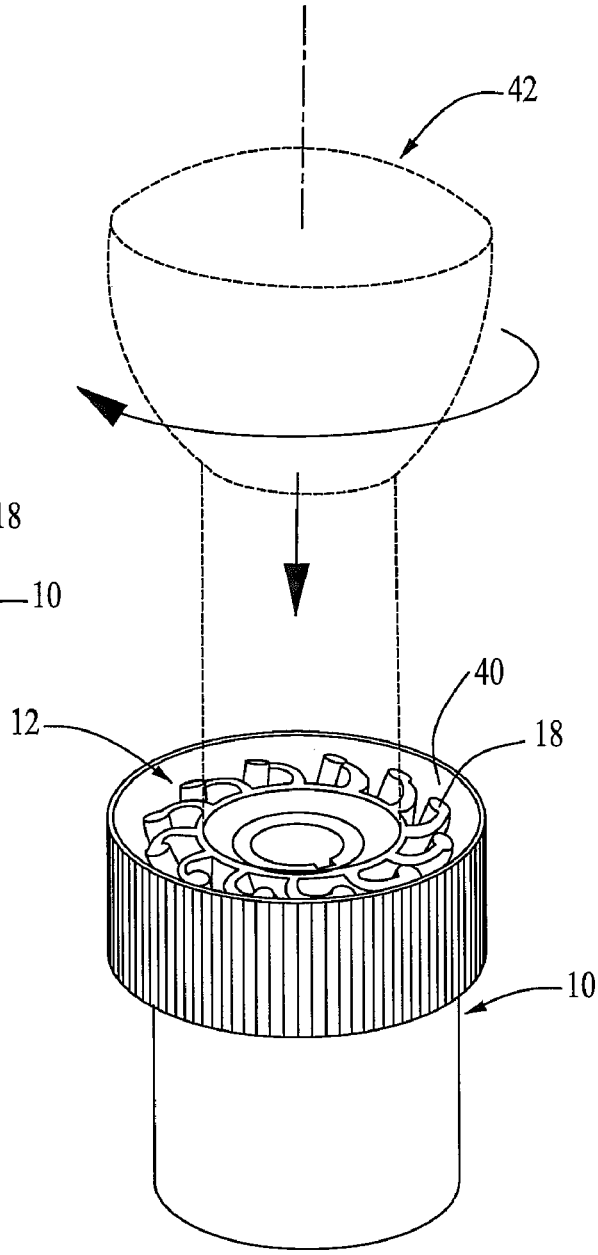
FIG. 5 is a perspective view of a second stage of the loading of the impeller into the tool of the present invention with the use of the pressing device of FIG. 3 and wherein the pressing device is illustrated in broken lines.

The impeller 12 disposed in the upper portion of the tool, as shown in FIG. 5, is then pushed to the bottom of the tool and the tool is inserted into the impeller cavity 14 in the water pump 16 which, as a result of the sizing of the outer diameter of the lower portion 34 of the tool relative to the size of the impeller cavity as earlier described, positions the impeller in axial alignment with the water pump shaft 28. The tool 10 is then rotated to align the keying features 24 and 26 on the impeller hub and water pump shaft, and urged downwardly causing the impeller to move along the water pump drive shaft 28 with the tool to the bottom of the impeller cavity (see FIG. 7). Again, this can be done solely by hand or with the aid of a pressing device. Upon the impeller 12 being driven downwardly within the impeller cavity 14 such that it is adjacent to the cavity floor, the pressing device 42 (if used) is removed, followed by the withdrawal of the impeller installation tool 10. As the tool 10 is lifted upwardly, it is rotated in the direction of rotation of the water pump shaft 28. During the withdrawal of the tool 10, the friction between the water pump drive shaft 28 and the impeller hub 20 will hold the impeller 12 in place in the impeller cavity 14, completing the installation of the impeller.

Various changes and modifications will be made in carrying out the present invention without departing from the spirit and scope thereof. Insofar as such changes and modifications are within the purview of the appended claims, they are to be considered as part of the present invention.

What is claimed is:

1. A tool for installing a flexible impeller on a drive shaft in the impeller cavity in a water pump of the type having an impeller insert cam extending about an outer portion of the impeller cavity, said tool comprising: a gripping surface extending about an upper portion of said tool; an open ended channel extending axially through said tool for receiving and releasably retaining a flexible impeller therein in a compressed state, said channel having an upper portion circumscribed by an annular outwardly inclined impeller abutment surface and a lower constant radius portion at least substantially circumscribed by a thin substantially rigid depending cylindrical wall adapted to extend into an impeller cavity for the transfer of an impeller in a compressed state from said channel into the impeller cavity and wherein said inclined impeller abutment surface terminates in said lower constant radius portion of said channel.

2. The tool of claim 1 wherein said inclined tool abutment surface defines an angle of inclination of about 30°.

3. The tool of claim 2 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

4. The tool of claim 1 wherein said depending cylindrical wall has a thickness of about 0.035-0.055 inches.

5. The tool of claim 1 wherein said impeller engaging surface defines an angle of inclination of about 30° and said depending cylindrical wall has a thickness of about 0.035-0.040 inches.

6. The tool of claim 1 wherein said inclined tool abutment surface defines an angle of inclination of about 15°-45°.

7. The tool of claim 6 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

8. The tool of claim 1 wherein said impeller engaging surface defines an angle of inclination of about 15°-45° and said depending cylindrical wall has a thickness of about 0.035-0.055 inches.

9. The tool of claim 8 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

10. The tool of claim 1 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

11. A tool for installing a flexible impeller on a drive shaft in the impeller cavity in a water pump of the type having an impeller insert cam extending about an outer portion of the impeller cavity, said tool comprising: a gripping surface extending about an upper portion of said tool; an open ended channel extending axially through said tool for receiving and releasably retaining a flexible impeller therein in a compressed state, said channel having an upper portion circumscribed by an annular outwardly inclined impeller abutment surface and a lower constant radius portion at least substantially circumscribed by a thin substantially rigid depending cylindrical wall adapted to extend into an impeller cavity for the transfer of an impeller in a compressed state from said channel into the impeller cavity and wherein said inclined impeller abutment surface terminates in said lower constant radius portion of said channel and defines an angle of inclination of about 15°-45°, said depending cylindrical wall has a thickness of about 0.035-0.055 inches and said gripping surface defines surface irregularities therein to facilitate the holding and rotating of the tool.

12. A tool for installing a flexible impeller on a drive shaft in the impeller cavity in a water pump of the type having an impeller insert cam extending about an outer portion of the impeller cavity, said tool comprising: a gripping surface extending about an upper portion of said tool; an open ended channel extending axially through said tool for receiving and releasably retaining a flexible impeller therein in a compressed state, said channel having an upper portion circumscribed by an annular outwardly inclined impeller abutment surface and a lower constant radius portion at least substantially circumscribed by a thin substantially rigid depending cylindrical wall adapted to extend into an impeller cavity for the transfer of an impeller in a compressed state from said channel into the impeller cavity and wherein said inclined impeller abutment surface terminates in said lower constant radius portion of said channel and defines an angle of inclination of about 15°-45°, said depending cylindrical wall has a thickness of about 0.035-0.055 inches and said gripping surface defines serrations therein.

13. A tool for installing a flexible impeller on a drive shaft in the impeller cavity in a water pump of the type having an impeller insert cam extending about an outer portion of the impeller cavity, said tool comprising: an open ended channel extending axially through said tool for receiving and releasably retaining a flexible impeller therein in a compressed state, said channel having an upper portion circumscribed by an annular outwardly inclined impeller abutment surface and a lower constant radius portion at least substantially circumscribed by a thin substantially rigid depending cylindrical wall adapted to extend into an impeller cavity for the transfer of an impeller in a compressed state from said channel into the impeller cavity and wherein said inclined impeller abutment surface terminates in said lower constant radius portion of said channel.

14. The tool of claim 13 wherein said inclined tool abutment surface defines an angle of inclination of about 30°.

15. The tool of claim 13 wherein said depending cylindrical wall has a thickness of about 0.0350.055 inches.

16. The tool of claim 13 wherein said impeller engaging surface defines an angle of inclination of about 30° and said depending cylindrical wall has a thickness of about 0.035-0.055 inches.

17. The tool of claim 13 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

18. The tool of claim 13 wherein said depending cylindrical wall has a thickness of about 0.035-0.055 inches.

19. The tool of claim 13 wherein said impeller engaging surface defines an angle of inclination of about 15°-45° and said depending cylindrical wall has a thickness of about 0.035-0.040 inches.

20. The tool of claim 19 wherein said cylindrical wall defines an outside diameter substantially equal to the inner diameter of a water pump cavity less twice the maximum radial thickness of the impeller insert cam extending about an upper portion of the water pump cavity, less a clearance factor of about 0.003 inches.

21. A method for installing a flexible impeller on a drive shaft in the impeller cavity in a water pump of the type having an impeller insert cam extending about an outer portion of the impeller cavity and mating keying features on the impeller and the drive shaft of the pump, said method comprising:

urging the impeller into an upper portion of a constant radius cylinder in a compressed disposition wherein the impeller blades are uniformly deflected in a given direction, said cylinder being sized so as to axially align a compressed impeller disposed therein with a drive shaft of a water pump upon the constant radius cylinder being inserted into the impeller cavity;

pushing the compressed impeller to the bottom of the constant radius cylinder;

axially aligning the constant radius cylinder with the impeller compressed therein with the impeller cavity of the pump;

rotating the cylinder relative to the pump to radially align the keying features on the impeller and the drive shaft while urging the cylinder and compressed impeller downwardly within the impeller cavity about the drive shaft; and withdrawing the cylinder from the impeller cavity in the pump while rotating the cylinder in said given direction or deflection whereby friction between the drive shaft and impeller will hold the impeller in place about the drive shaft of the pump.

22. The method of claim 21 including the step of lubricating the impeller prior to urging the impeller into an upper portion of a constant radius cylinder and wherein said first urging step comprises pressing the impeller against an annular outwardly inclined surface adjacent said upper portion of said constant radius cylinder while concurrently rotating the impeller downwardly to deflect the impeller blades in said given direction as the impeller is urged into the cylinder.

* * * * *